United States Patent [19]

Hain

[11] Patent Number: 4,997,176

[45] Date of Patent: Mar. 5, 1991

[54] APPARATUS FOR STACKING ARTICLES IN A CONTAINER

[75] Inventor: David A. Hain, Monifieth, Scotland

[73] Assignee: NCR Corporation, Dayton, Ohio

[21] Appl. No.: 433,093

[22] Filed: Nov. 8, 1989

[30] Foreign Application Priority Data

Jun. 30, 1989 [GB] United Kingdom ..... 8915126

[51] Int. Cl.[5] ..... B65H 29/44

[52] U.S. Cl. ..... 271/180; 271/181; 271/189; 271/192; 414/794.7; 109/24.1; 902/8

[58] Field of Search ..... 271/177, 180, 198, 220, 271/274, 181, 189, 192; 414/794.2, 794.4; 109/24.1, 55, 66; 902/8, 9, 10, 36; 232/43.2

[56] References Cited

U.S. PATENT DOCUMENTS

| | | | |
|---|---|---|---|
| 1,210,168 | 12/1916 | Heyer | 271/180 |
| 3,655,186 | 4/1972 | Bayha | 271/180 |
| 3,866,235 | 2/1975 | Maynard et al. | 902/9 X |
| 3,959,951 | 6/1976 | Paules | 414/794.4 X |
| 3,977,669 | 8/1976 | Douno | 271/180 |
| 3,988,019 | 10/1976 | Achelpohl | 271/198 X |
| 4,512,263 | 4/1985 | Lanning | 109/66 |
| 4,540,106 | 9/1985 | Fukatsu | 109/24.1 X |

FOREIGN PATENT DOCUMENTS

| | | | |
|---|---|---|---|
| 0166253 | 5/1985 | European Pat. Off. . | |
| 0058494 | 5/1979 | Japan | 271/180 |
| 0188338 | 8/1986 | Japan | 271/181 |
| 0235347 | 10/1986 | Japan | 271/180 |
| 0267625 | 11/1988 | Japan | 271/180 |
| WO86/05301 | 2/1986 | PCT Int'l Appl. . | |
| 2091225 | 12/1981 | United Kingdom . | |

OTHER PUBLICATIONS

U.S. patent application Ser. No. 433,497, filed Nov. 8, 1989 (NCR Docket No. 4247).

*Primary Examiner*—H. Grant Skaggs
*Assistant Examiner*—James R. Bidwell
*Attorney, Agent, or Firm*—Wilbert Hawk, Jr.; Albert L. Sessler, Jr.

[57] ABSTRACT

A despository apparatus for stacking envelopes in a container (24) includes a transport (16) for conveying an envelope (122') from an entry slot (22) of the apparatus into a receiving zone of the container (24), the receiving zone being separated from a storage zone of the container (24) by resiliently mounted flaps which in operation permit one-way passage of an envelope from the receiving zone into the storage zone. A pusher block (146) is arranged to push an envelope in the receiving zone past the flaps and into the storage zone against the pressure exerted by a block of elastomeric material held in the storage zone in a somewhat compressed condition. For the purpose of simplifying the construction of the apparatus, there is employed a single bidirectional electric motor (80) for driving the transport (16) when operating in one sense, and for driving an actuator (108) for the pusher block (146) when operating in the opposite sense.

16 Claims, 5 Drawing Sheets

APPARATUS FOR STACKING ARTICLES IN A CONTAINER

CROSS REFERENCE TO RELATED APPLICATION

Container for Holding a Stack of Articles, Ser. No. 07/433,497 filed 11/08/89, inventor David A. Hain.

BACKGROUND OF THE INVENTION

This invention relates to an apparatus for stacking articles in a container.

The invention has application, for example, to a depository apparatus included in an automated teller machine (ATM) of the kind which is arranged to dispense currency notes, or accept a deposit of money, as may be required by a customer. As is well known, in operation of an ATM of this kind, a user inserts a customer-identifying card into the machine and then enters certain data (such as a personal identification number, type of transaction, and quantity of money required or to be paid in) on one or more keyboards included in a user console of the machine. The machine will then process the transaction, dispense currency notes or accept a money deposit as may be requested, and return the card to the user as part of a routine operation. If money is to be deposited, the user typically inserts an envelope containing the money (cash and/or checks) through a deposit entry slot in the user console, and the depository apparatus of the ATM transports the envelope to, and deposits it in, a portable container included in the apparatus.

In some known types of depository apparatus, envelopes are simply dropped one by one by a transport mechanism into a portable container. Such an apparatus has the disadvantage that envelopes are deposited in a non-orderly manner in the container, thereby reducing the storage capacity of the container and hindering checking and reconciliation procedures when the envelopes are removed from the container.

A depository apparatus in which envelopes are stacked in an orderly sequential manner in a container is known from U.S. Pat. No. 4,512,263. In operation of this known apparatus, each envelope to be stacked is fed under gravity into a receiving zone which is separated from a storage zone by gate means arranged to permit one-way passage of the envelope from the receiving zone into the storage zone. When in the receiving zone, each envelope is supported by one of its edges in a vertical position, and pusher means are provided for pushing the envelope past the gate means into the storage zone against the pressure of a vertical support plate which is positioned in the storage zone and which is resiliently biased towards the gate means. This known apparatus has the disadvantage that, since each envelope to be stacked is supported on one edge in the receiving zone, the apparatus does not operate satisfactorily with envelopes which do not have a sufficient degree of stiffness.

SUMMARY OF THE INVENTION

In accordance with one embodiment of the invention, an apparatus for stacking articles in a container, said apparatus having an entry aperture, said container having a receiving zone and a storage zone, comprises: resilient support means mounted in said storage zone of said container; transport means for conveying articles from the entry aperture of said apparatus to the receiving zone of said container; gate means for separating said receiving zone from said storage zone and for permitting one-way passage of articles from said receiving zone into said storage zone; pusher means movable from a home position to an operated position to push an article which is in said receiving zone past said gate means against pressure from said resilient support means; actuating means for operating said pusher means; operating means for operating said actuating means; and bidirectional drive means for driving said transport means when operating in one direction and for operating said operating means when operating in the other direction to cause said actuating means to move in a reciprocating manner, which in turn causes said pusher means to be moved from said home position to said operated position and to be returned to said home position.

It is an object of the invention to provide an apparatus for stacking articles in a container, which apparatus is of simple construction and alleviates the disadvantage referred to above.

One embodiment of the invention will now be described by way of example with reference to the accompanying drawings.

DESCRIPTION OF THE PREFERRED EMBODIMENT

Figure 1:
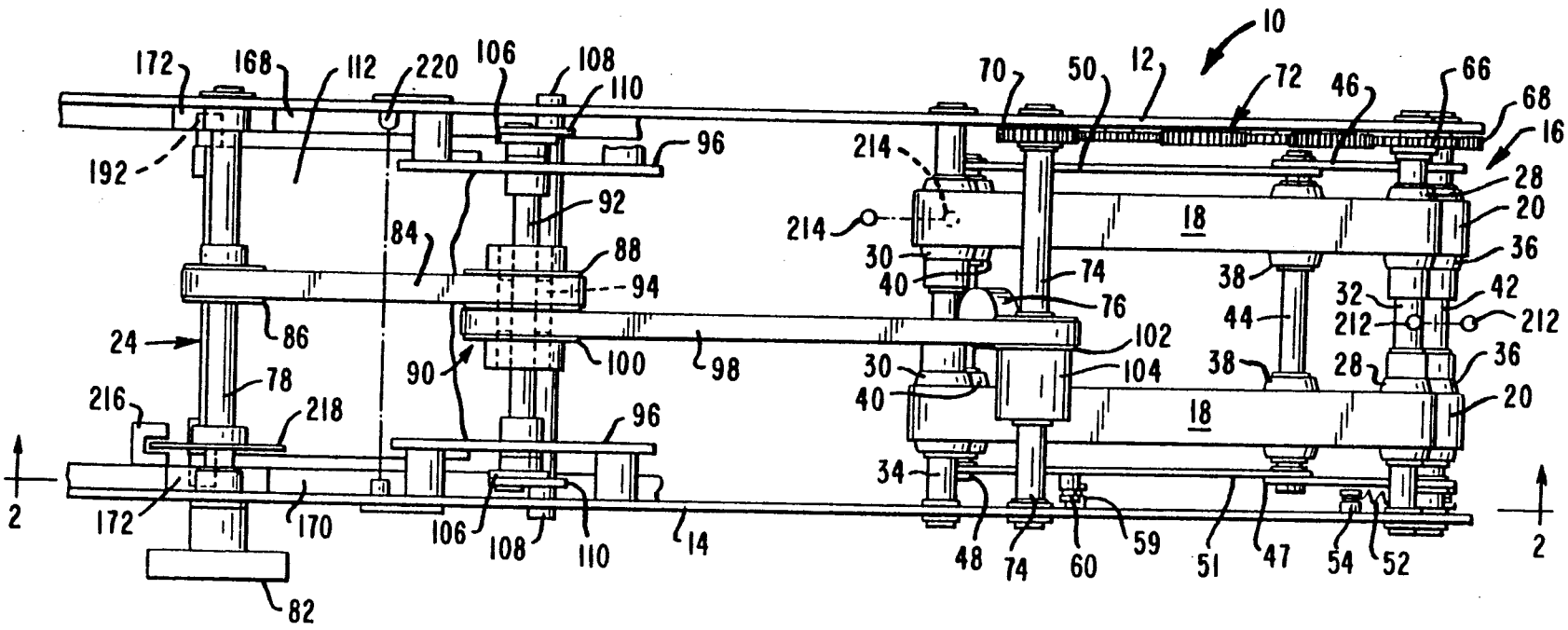
FIG. 1 is a plan view of a depository apparatus in accordance with the invention.
Figure 2:
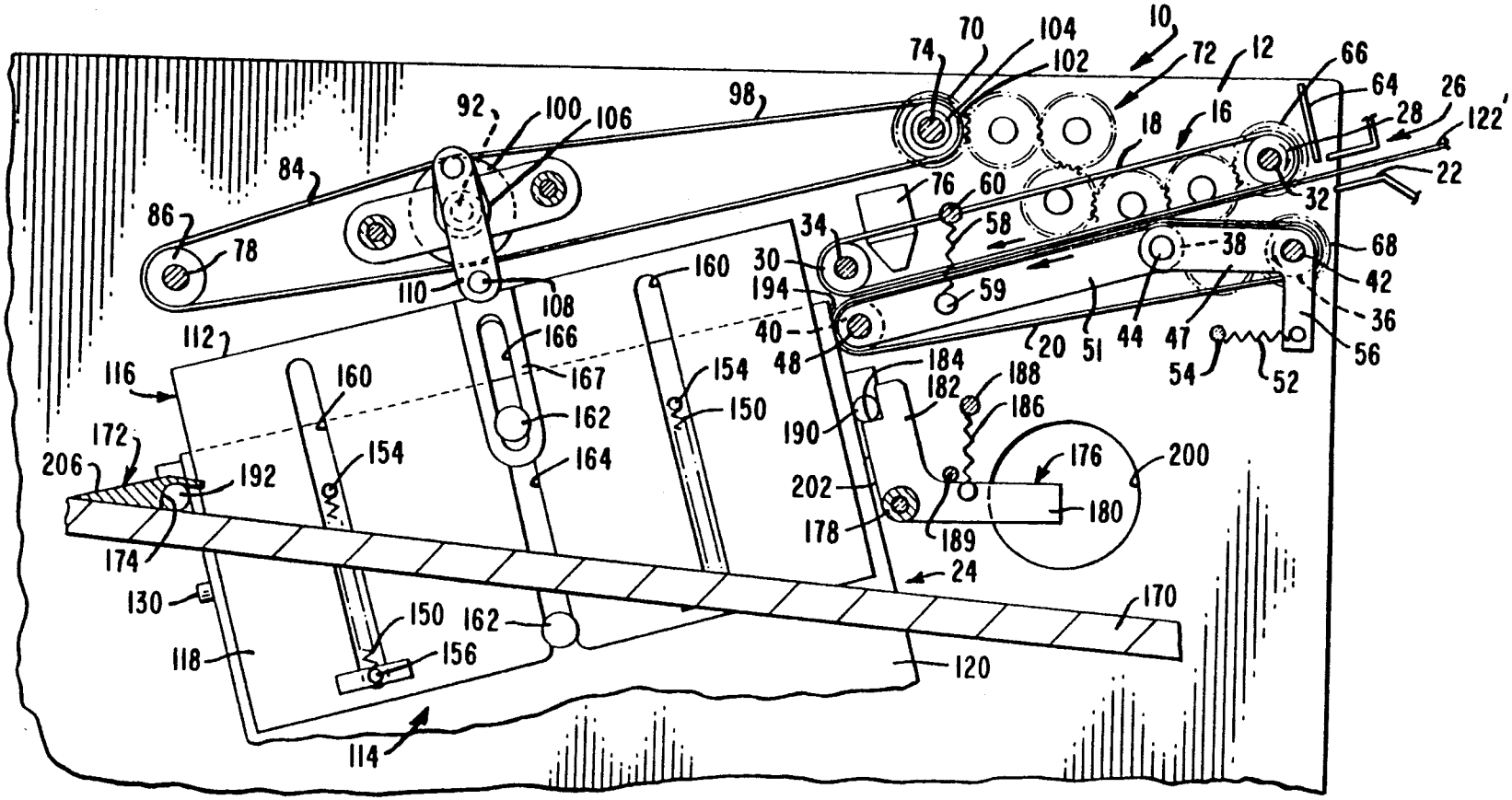
FIG. 2 is a sectional, side elevational view of the depository apparatus, the section being taken along the line 2—2 of FIG. 1.

Referring to FIGS. 1 and 2, the depository apparatus shown therein includes a supporting framework 10 having side walls 12 and 14. The depository apparatus includes a transport mechanism 16 having an upper pair of endless belts 18 and a lower pair of endless belts 20 which respectively cooperate with the belts 18. The cooperating belts 18 and 20 serve to feed envelopes, such as the envelope 122' shown in FIG. 2, from an entry slot 22 to a depository container 24 (shown partly broken away in each of FIGS. 1 and 2), the entry slot 22 being located in a user console 26 (not shown in FIG. 1) of an ATM in which the depository apparatus is included. As will be explained later, the depository container 24 is readily removable from, or insertable in, the framework 10.

Each of the belts 18 passes around respective pulleys 28 and 30. The pulleys 28 are secured on a shaft 32 and the pulleys 30 are secured on a shaft 34, the shafts 32 and 34 extending between, and being rotatably mounted with respect to, the side walls 12 and 14. Each of the belts 20 passes around respective pulleys 36, 38 and 40. The pulleys 36 are secured on a shaft 42 which extends between, and is rotatably mounted with respect to, the side walls 12 and 14, the pulleys 38 are rotatably mounted on a shaft 44 extending between corresponding ends of a first pair of support arms 46 and 47 which are respectively positioned adjacent the side wall 12 and 14, and the pulleys 40 are rotatably mounted on a shaft 48 extending between corresponding ends of a second pair of support arms 50 and 51 which are also respectively positioned adjacent the side walls 12 and 14. The ends of the support arms 46 and 47 remote from the shaft 44 are pivotably mounted on the shaft 42, and the ends of the support arms 50 and 51 remote from the shaft 48 are pivotably mounted on the shaft 44.

The assembly of the support arms 46, 47 and shaft 44 is biased in a clockwise direction (with reference to FIG. 2) about the axis of the shaft 42 by means of a spring 52 connected between a stud 54 secured to the side wall 14 and a projection 56 projecting from the arm 47. (It should be understood that, hereinafter, any reference to clockwise direction or counterclockwise direction will be with reference to FIG. 2). The assembly of the support arms 50 and 51 and shaft 48 is biased in a clockwise direction about the axis of the shaft 44 by means of a spring 58 connected between a stud 59 on the arm 51 and a further stud 60 secured to the side wall 14.

Those portions of the upper parts of the belts 20 extending between the pulleys 40 and 38 are respectively positioned in cooperative relationship with corresponding portions of the belts 18, while those portions of the upper parts of the belts 20 extending between the pulleys 38 and 36 are directed away from the belts 18 so as to form an entry throat adjacent the entry slot 22. It should be understood that normally the entry slot 22 is closed by a shutter 64 (not shown in FIG. 1). When a user of the ATM has indicated that he wishes to deposit an envelope containing money in the ATM, the shutter 64 is retracted in an upwards direction by an actuating solenoid 65 (FIG. 6) to the position shown in FIG. 2 so as to enable the user to insert the envelope 122' through the entry slot 22 and into the entry throat with a short edge of the envelope leading, whereupon the leading edge of the envelope 122' is gripped by the cooperating portions of the belts 18 and 20.

The shafts 32 and 42 are respectively driven by gears 66 and 68 in the directions indicated by the associated arrows in FIG. 2. The gears 66 and 68 are in turn driven by a gear 70 via a gear train 72, the gear 70 being mounted on a shaft 74 which extends between, and is rotatably mounted with respect to, the side walls 12 and 14. When the shafts 32 and 42 are driven by the gears 66 and 68, the belts 18 and 20 convey the envelope 122' from the entry slot 22 into the depository container 24 in a manner to be described in more detail later. By virtue of the fact that the shafts 44 and 48 carrying the pulleys 38 and 40 are mounted on the resiliently supported arms 46, 47 and 50, 51, envelopes having a wide range of thicknesses (up to 1.25 centimeters thick) can be conveyed by the belts 18 and 20 to the container 24.

An ink jet printer 76 is mounted by support means (not shown) between the belts 18, the printer 76 being arranged to print identifying information on each envelope as it is conveyed from the entry slot 22 to the container 24.

A drive shaft 78 extends between, and is rotatably mounted with respect to, the side walls 12 and 14. The drive shaft 78 is positioned adjacent the rear of the framework 10, that is to say the end of the framework 10 remote from the user console 26, and is driven by a bidirectional electric motor 80 (FIG. 6) via transmission means which includes a pulley 82 but which is not otherwise shown. An endless belt 84 passes around a pulley 86 secured on the drive shaft 78 and around a first pulley portion 88 of a composite pulley 90. The pulley 90 is mounted on a shaft 92 by means of a roller clutch 94, the shaft 92 extending between, and being rotatably mounted with respect to, two support brackets 96. The brackets 96 are respectively secured to, and spaced from the inner faces of, the side walls 12 and 14.

When the drive shaft 78 is driven in a clockwise direction by the motor 80, the roller clutch 94 enables the composite pulley 90 to rotate freely on the shaft 92 without any drive being transmitted to the shaft 92. When the drive shaft 78 is driven in a counterclockwise direction by the motor 80, the roller clutch 94 transmits drive to the shaft 92 so as to cause the shaft 92 to rotate in a counterclockwise direction. A further endless belt 98 passes around a second pulley portion 100 of the composite pulley 90 and around a pulley 102 which is mounted on the shaft 74 by means of a roller clutch 104. When the composite pulley 90 is driven in a clockwise direction by the belt 84, the roller clutch 104 transmits drive to the shaft 74 so as to cause the shaft 74 to rotate in a clockwise direction, but, when the pulley 90 is driven in a counterclockwise direction by the belt 84, the pulley 102 rotates freely on the shaft 74 without any drive being transmitted to the shaft 74.

Thus, it will be appreciated that, when the motor 80 drives the drive shaft 78 in a clockwise direction, drive is transmitted to the transport mechanism 16 via the belts 84 and 98, the pulleys 90 and 102, the shaft 74 and the gears 70, 72, 66, 68, with no drive being transmitted to the shaft 92. On the other hand, when the motor 80 drives the drive shaft 78 in a counterclockwise direction, no drive is transmitted to the transport mechanism 16, but drive is transmitted to the shaft 92 so as to cause it to rotate in a counterclockwise direction.

Two crank arms 106 are respectively secured to the ends of the shaft 92, each crank arm 106 being located in the space between the relevant side wall 12 or 14 and the adjacent bracket 96. A rod 108 passes through, and is supported by, corresponding ends of two link members 110, the other ends of the link members 110 being respectively pivotably connected to the free ends of the crank arms 106. The ends of the rod 108 respectively slidably engage in two slots (not shown) which are respectively formed in the side walls 12 and 14 and which extend in a direction perpendicular to the top surface 112 of the depository container 24. Thus, rotation of the shaft 92 brings about a reciprocable movement of the rod 108 in this last-mentioned direction via the crank arms 106 and link members 110. In the following description relating to the depository container 24 this last-mentioned direction will be considered to be a vertical direction.

Figure 3:
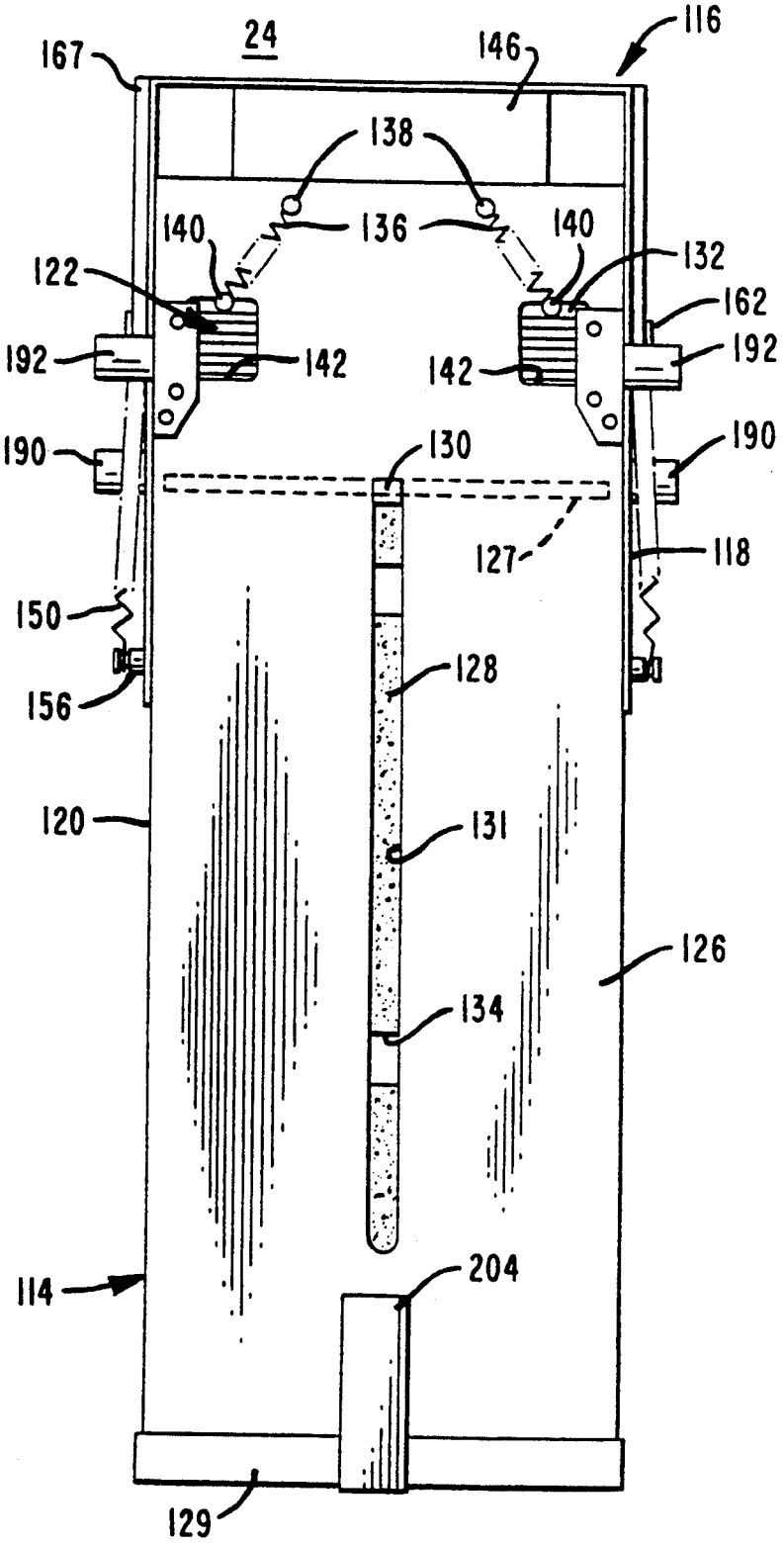
FIG. 3 is a rear elevational view of a depository container included in the apparatus of FIGS. 1 and 2.
Figure 4:
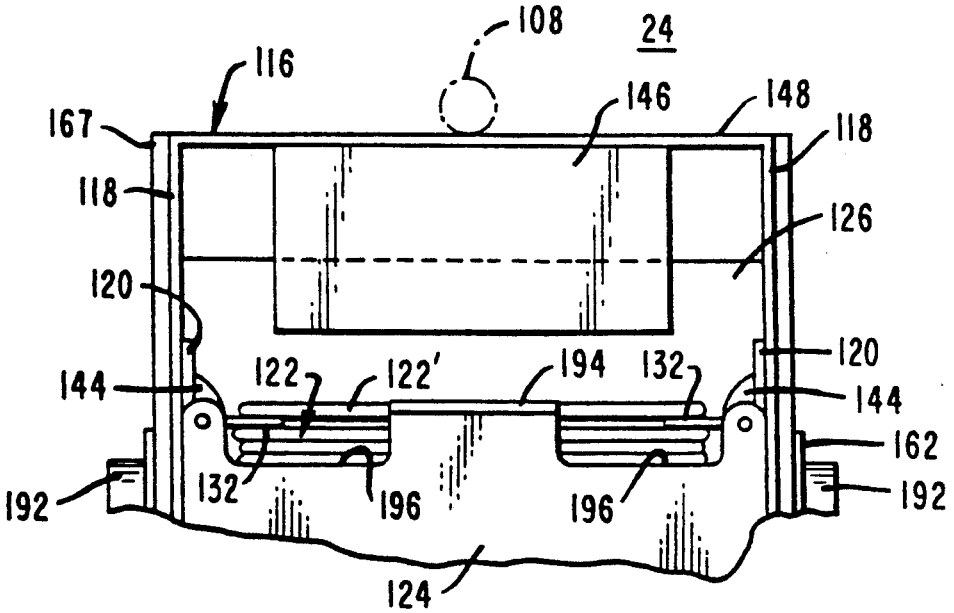
FIG. 4 is an enlarged front elevational view of the top portion of the depository container at the beginning of an envelope pushing operation in which an envelope is pushed into a storage bin of the depository container.
Figure 5:
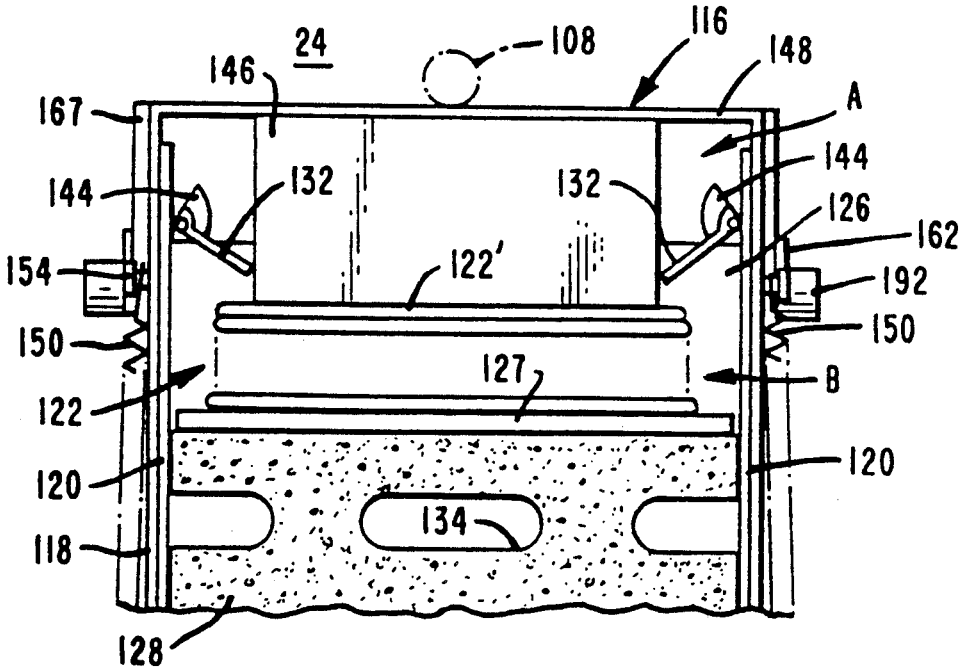
FIG. 5 is a view similar to FIG. 4 but with the front wall omitted and showing the depository container halfway through an envelope pushing operation.

Referring now also to FIGS. 3 to 5, the depository container 24 comprises an envelope storage bin 114 open at the top, and a pusher portion 116 which fits over the top of the bin 114, the pusher portion 116 having downwardly projecting side walls 118 which are respectively in sliding engagement with the outer faces of side walls 120 of the bin 114. The storage bin 114 is adapted to hold a stack of envelopes 122, with the long edges of each envelope respectively adjacent the side walls 120, and with the short edges of each envelope respectively adjacent the front wall 124 and the rear wall 126 of the bin 114. The lower end of the stack of envelopes 122 is supported on a plate 127 carried on the top of a block 128 of elastomeric plastics material, such as polyurethane, which is supported by the base 129 of the bin 114. An extension arm 130 secured to the plate 127 passes through a vertically extending slot 131 formed in the rear wall 126. Normally, as shown in FIG. 4, the uppermost envelope in the stack 122 is in engagement with the undersides of two flaps 132 which are respectively pivotably mounted on, and extend along the horizontal dimensions of, the inner faces of the side walls 120.

The elastomeric block 128 is in a somewhat compressed condition so as to cause the uppermost envelope in the stack 122 to bear resiliently against the flaps 132. Preferably, a number of cavities 134 are formed in the elastomeric block 128 so as to enhance the compressibility thereof. The block 128 is sufficiently compressible that it can be compressed to one quarter of its height when in a non-compressed condition. The flaps 132 are normally held in horizontal positions, as shown in FIGS. 3 and 4, by means of two springs 136 (FIG. 3). The springs 136 are connected between studs 138 secured to the outer surface of the rear wall 126 and projections 140 respectively formed on the flaps 132, the projections 140 passing through two apertures 142 formed in the wall 126. Upward pivotal movement of the flaps 132 away from their horizontal positions is prevented by two lugs 144 which are respectively secured to the flaps 132 and which are arranged to engage with the inner faces of the side walls 120 of the bin 114 when the flaps 132 are in their horizontal positions.

As will be described in more detail later, the flaps 132 can be pivoted downwardly away from their normal horizontal positions against the action of the springs 136 and the pressure exerted by the elastomeric block 128 so as to permit an envelope to pass from a receiving zone A (FIG. 5) of the depository container 24 above the flaps 132 into a storage zone B (FIG. 5) of the container 24 below the flaps 132. As will be clear from the subsequent description, the flaps 132 serve as gate means for permitting one-way passage of envelopes one by one from the receiving zone A into the storage zone B.

A pusher block 146 is secured to the lower face of the upper wall 148 of the pusher portion 116, the block 146 being of rectangular cross section and extending along substantially the whole length of the upper wall 148. It should be understood that the upper surface of the wall 148 constitutes the top surface 112 of the depository container 24 as shown in FIGS. 1 and 2. The width of the block 146 is somewhat greater than the spacing apart of the flaps 132 so that the block 146 is capable of engaging with the flaps 132 for the purpose of pivoting the flaps 132 downwardly. The pusher block 146 is normally held out of engagement with the flaps 132 by means of two pairs of springs 150, each pair of springs 150 being connected between studs 154 secured to a respective one of the side walls 120 of the bin 114 and studs 156 secured to the adjacent side wall 118 of the pusher portion 116. Each of the studs 154 passes through a respective slot 160 (FIG. 2) formed in the relevant side wall 118. Each side wall 120 is provided with a pair of guide studs 162 arranged one above the other, each pair of guide studs 162 slidably engaging in a respective slot 164 (FIG. 2) formed in the relevant side wall 118. The pusher portion 16 can be moved downwardly relative to the bin 114 against the action of the springs 150, with the two pairs of guide studs 162 sliding along the slots 164.

When the depository container 24 is not mounted in the ATM, upward movement of the pusher portion 116 relative to the bin 114 is limited by the engagement of the upper ones of the studs 162 with the closed lower ends of two slots 166 respectively formed in two plates 167 secured to the side walls 118. As shown in FIGS. 2, 4 and 5, when the depository container 24 is mounted in its correct operational position in the ATM, the rod 108 is in engagement with the upper face of the upper wall 148 of the pusher portion 116, the pusher portion 116 being urged resiliently against the rod 108 by the springs 150. Thus, it will be appreciated that, in operation, upward and downward movement of the pusher portion 116 relative to the bin 114 is brought about in response to upward and downward movement of the rod 108.

The inner faces of the side walls 12 and 14 of the framework 10 are respectively provided with two generally horizontally extending guide rails 168 and 170. Two stop members 172, each having a stop surface 174, are respectively secured to the inner faces of the side walls 12 and 14 and are positioned on the rails 168 and 170 adjacent the rear of the framework 10. Two latch members 176 (not shown in FIG. 1) in the form of bell crank levers are pivotably mounted on two studs 178 respectively secured to the inner faces of the side walls 12 and 14, the latch members 176 being spaced upwardly from the rails 168 and 170 and being positioned a short distance below the pulleys 40. Each latch member 176 comprises a forwardly projecting arm 180 and an upwardly projecting arm 182 provided at its upper end with a rearwardly facing recess 184. Each latch member 176 is biased in a counterclockwise direction by means of a respective spring 186 connected between the arm 180 and a stud 188 secured to the relevant side wall 12 or 14, so as to urge the arm 180 into engagement with a further stud 189 secured to the relevant side wall 12 or 14.

A first pair of support studs 190 are secured to the front wall 124 of the bin 114, and a second pair of support studs 192 are secured to the rear wall 126. The central portion of the upper end of the front wall 124 is formed as a curved guide member 194 with recesses 196 on both sides thereof. When the depository container 24 is mounted in its correct operational position in the framework 10, the studs 192 are supported on the rails 168 and 170 and are in engagement with the stop surfaces 174 of the stop members 172, and the studs 190 are located in, and are supported by, the recesses 184 of the latch members 176, the latch members 176 being held by the springs 186 in supporting positions in relation to the studs 190. With the depository container 24 in the operational position just described, the adjacent ends of the endless belts 20 protrude a short distance into the recesses 196, and the guide member 194 is aligned with the upper surfaces of the belts 20 as seen in FIG. 2.

In order to remove the depository container 24 from the depository apparatus, the latch members 176 are pivoted in a clockwise direction against the action of the springs 186 by manual operation of the arms 180 of the latch members 176 through openings 200 respectively formed in the side walls 12 and 14 of the framework 10. This pivotal movement of the latch members 176 disengages the recesses 184 from the studs 190, whereupon the depository container 24 can be pivoted in a clockwise direction about the axis of the studs 192 until the studs 190 engage the rails 168 and 170. Thereafter the depository container 24 can be removed from the depository apparatus through open door means (not shown) at the front of the ATM, the container 24 initially passing under the belts 20 of the transport mechanism 16 with the studs 190 and 192 sliding along the rails 168 and 170.

The manner in which the depository container 24 is inserted in the ATM is substantially a reversal of the manner in which the container 24 is removed. Thus, the depository container 24 is inserted between the side walls 12 and 14 through the afore-mentioned open door means with first the studs 192 and then the studs 190 engaging with the upper surfaces of the rails 168 and 170. The container 24 is slid along the rails 168 and 170 until the studs 192 engage with the stop surfaces 174 of the stop members 172. The container 24 is then pivoted in a counterclockwise direction about the axis of the studs 192 until the studs 190 engage in the recesses 184 in the latch members 176. During this pivotal movement of the container 24, the studs 190 engage with cam surfaces 202 on the latch members 176 so as to cause the latch members 176 to pivot in a clockwise direction against the action of the springs 186. Upon the studs 190 moving past the lower edges of the recesses 184, the latch members 176 snap back into supporting positions in respect of the studs 190 so as to latch the depository container 24 securely and accurately in its correct operational position in the framework 10.

The base 129 of the bin 114 is removable and is normally held in position by means of latches 204 provided at the front and rear of the bin 114. When it is desired to remove envelopes from the depository container 24, for example when indicating means (to be described hereinafter) indicate that the container 24 is full, the latches 204 are released so as to enable the base 129 to be removed from the remainder of the bin 114. The stack of envelopes 122 can then be removed from the container 24 through the open bottom of the bin 114, after the elastomeric block 128 and the plate 127 have first been removed.

In an alternative arrangement of the depository apparatus described above, the depository container 24 could be incorporated in a rear loading ATM, that is to say the container 24 could be removed from, and inserted in, the depository apparatus via open door means (not shown) at the rear of the ATM. In this alternative arrangement, in order to remove the depository container 24 from the depository apparatus, the latch members 176 are disengaged from the studs 190 and, as previously described, the container 24 is pivoted in a clockwise direction until the studs 190 engage the rails 168 and 170. Thereafter, the container 24 is moved forwardly a short distance along the rails 168 and 170 to disengage the studs 192 from the stop members 172, and then the container 24 is slid rearwardly along the rails 168 and 170 out of the framework 10, with first the studs 192, and then the studs 190, being lifted over the stop members 172. When inserting the container 24 into the depository apparatus in accordance with this alternative arrangement, the container 24 is slid rearwardly along the rails 168 and 170 with the studs 190 and 192 riding over the stop members 172 along inclined surfaces 206 of the stop members 172. After the studs 192 have been moved over the stop members 172, the container 24 is moved rearwardly a short distance to engage the studs 192 with the stop surfaces 174 of the stop members 172. The insertion operation is then completed by rotating the container 24 in a counterclockwise direction about the axis of the studs 192 until the studs 190 are fully engaged in the recesses 184 in the latching members 176.

Figure 6:
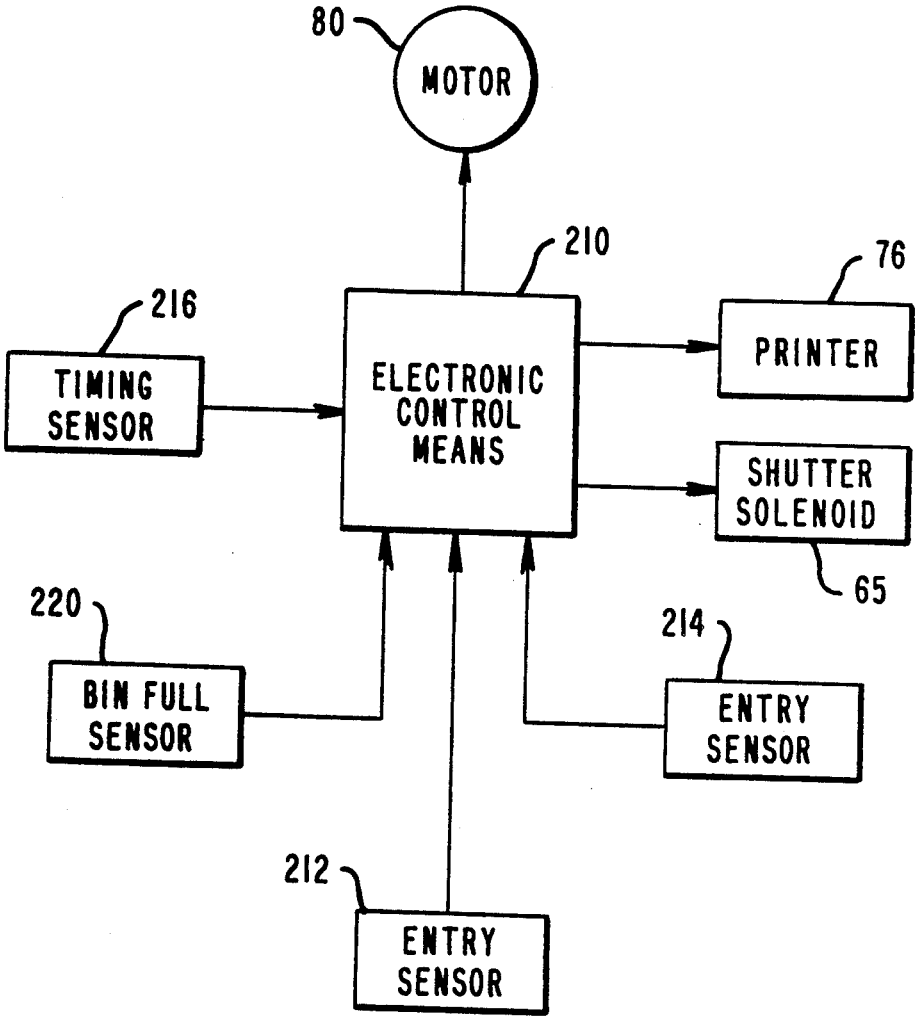
FIG. 6 is a schematic block diagram illustrating the electrical interconnections of parts of the depository apparatus.

The operation of the depository apparatus will now be described with additional reference to FIG. 6. Immediately prior to an envelope deposit operation being initiated, the motor 80 is in a deactivated condition, and the crank arms 106 and link members 110 are in the positions shown in FIG. 2 with the pusher portion 116 in its uppermost position relative to the bin 114, and with a stack of envelopes 122 (if any) already inserted in the depository container 24 being held between the plate 127 and the lower faces of the flaps 132. An envelope deposit operation is initiated by a user inserting a customer identifying card into a card entry slot (not shown) in the user console 26 and entering appropriate data upon keyboard means (not shown) also included in the user console 26. As a result of this operation being initiated, the shutter actuating solenoid 65 is energized by electronic control means 210 included in the ATM so as to cause the shutter 64 to be retracted.

Following the retraction of the shutter 64, the customer inserts the envelope 122' containing money through the entry slot 22 and into the entry throat of the belts 18 and 20 as previously described. The insertion of the leading edge of the envelope 122' into the entry throat of the belts 18 and 20 is sensed by optical sensor means 212 (FIGS. 1 and 6) which sends a signal to the electronic control means 210 for the purpose of causing the electronic control means 210 to activate the motor 80 in such a sense as to drive the drive shaft 78 in a clockwise direction and thereby cause the transport mechanism 16 to commence operation, with the belts 18 and 20 being driven in the direction of the associated arrows in FIG. 2.

Upon the commencement of operation of the transport mechanism 16, the envelope 122' is gripped by the belts 18 and 20 and is driven by the belts 18 and 20 to the depository container 24 past the printer 76. In response to receipt of a further signal from the sensor means 212 when the sensor means 212 senses the trailing edge of the envelope 122', the electronic control means 210 de-energizes the shutter actuating solenoid 65, thereby causing the shutter 64 to return to its blocking position, and initiates the operation of the printer 76. The printer 76 is operated under the control of the control means 210 so as to print on the envelope 122' information such as identifying information in respect of the customer, and the amount of money contained in the envelope 122' as entered by the customer on the keyboard means.

During the final part of the movement of the envelope 122' by the transport mechanism 16, the envelope 122' moves over the guide member 194 of the bin 114 and is deposited by the transport mechanism 16 in the interior of the depository container 24, with the long edges of the envelope 122' being respectively supported on the flaps 132 as shown in FIG. 4, and with the leading edge of the envelope 122' located adjacent the rear wall 126 of the bin 114. As the envelope 122' is deposited in the container 24, the trailing edge of the envelope 122' is sensed by further optical sensor means 214 (FIGS. 1 and 6) located adjacent the front wall 124 of the bin 114, whereupon the sensor means 214 sends a signal to the control means 210 so as to cause the control means 210 to deactivate the motor 80 and then, immediately thereafter, to activate the motor 80 in the opposite sense.

Activation of the motor 80 in the opposite sense serves to drive the drive shaft 78 in a counterclockwise direction. As previously described, rotation of the drive shaft 78 in a counterclockwise direction causes the assembly of the shaft 92 and crank arms 106 to rotate in a counterclockwise direction, which in turn initially causes the pusher portion 116 incorporating the pusher block 146 to move downwards under the action of the rod 108 connected to the link members 110; at this time the transport mechanism 16 is in a deactivated condition. As the pusher block 146 moves downwards it engages the envelope 122' supported on the flaps 132, and continued downward movement of the pusher block 146, against the pressure of the elastomeric block 128 and the springs 136, causes the flaps 132 to be pivoted downwards with the envelope 122 being moved past the flaps 132 and into juxtaposition with the top envelope of the stack of envelopes 122 already contained in the bin 114 beneath the flaps 132. When the pusher portion 116 reaches its lowermost position relative to the storage bin 114, the envelope 122', block 146 and flaps 132 are in the positions shown in FIG. 5. Continued rotation of the drive shaft 78 in a counterclockwise direction enables the pusher portion 116 and flaps 132 to return towards their home positions shown in FIG. 4 under the action of the elastomeric block 128 and the springs 136.

When the shaft 92 has completed exactly one revolution in a counterclockwise direction, then the electronic control means 210 causes the motor 80 to be deactivated, the pusher portion 116 and flaps 132 now being back in their home positions, and the newly deposited envelope 122' now being the uppermost envelope of the stack of envelopes contained in the bin 114. The stack of envelopes is held in position under the flaps 132 by virtue of being supported by the plate 127 and by virtue of the upward pressure exerted on the plate 127 by the elastomeric block 128. Referring to FIGS. 1 and 6, activation of the motor 80 is brought about by the electronic control means 210 under the control of timing signals from an optical sensor 216 operatively associated with a timing disc 218 (the sensor 216 and disc 218 not being shown in FIG. 2) secured on the drive shaft 78, the timing disc carrying a series of equally spaced, radially extending marks, and the timing signals being generated in response to the sensing of successive marks by the sensor 216. Thus, the timing signals are generated in synchronism with the rotation of the shaft 78, and also in synchronism with the rotation of the shaft 92.

Further envelopes can be deposited in the depository container 24 in the manner just described, all the deposited envelopes being contained in an orderly stack in the bin 114. When the bin 114 is full, as indicated by the extension arm 130 of the plate 127 being sensed by optical sensing means 220 (FIGS. 1 and 6), a BIN FULL signal is sent by the sensing means 220 to the control means 210. This signal inhibits further operation of the depository apparatus until after the depository container 24 has been removed from the apparatus or emptying, and the empty depository container 24, or a replacement depository container, has been placed in position in the apparatus.

The depository apparatus described above has the advantage that it is of simple construction in that a single electric motor operates both the transport mechanism 16 and the pusher portion 116. Also, the elastomeric block 128 provides a very cheap and simple resilient support means for the stack of envelopes 122 contained in the depository container 24. A further advantage of the depository apparatus is that the depository container 24 can be inserted into the apparatus from either the front or the rear of the apparatus, subject to the provision of suitable door means.

What is claimed is:

1. An apparatus for stacking articles in a container, said apparatus having an entry aperture, said container having a receiving zone and a storage zone, comprising:

resilient support means mounted in said storage zone of said container;

transport means for conveying articles from the entry aperture of said apparatus to the receiving zone of said container;

gate means for separating said receiving zone from said storage zone and for permitting one-way passage of articles from said receiving zone into said storage zone;

pusher means movable from a home position to an operated position to push an article which is in said receiving zone past said gate means against pressure from said resilient support means;

actuating means for operating said pusher means;

operating means for operating said actuating means; and bidirectional drive means for driving said transport means when operating in one direction and for operating said operating means when operating in the other direction to cause said actuating means to move in a reciprocating manner, which in turn causes said pusher means to be moved from said home position to said operated position and to be returned to said home position.

2. The apparatus of claim 1, in which said gate means comprises pivotally mounted flaps which are resiliently biased into horizontal home positions, and in which said transport means is arranged to drive an article into said receiving zone from one side of said container so that when the article is deposited in said receiving zone the article is supported by said flaps in their home positions.

3. The apparatus of claim 2, in which the pusher means includes a depending block capable of engaging said flaps to pivot them in a downward direction.

4. The apparatus of claim 1, in which said bidirectional drive means includes a bidirectional motor and also includes a first shaft for driving said operating means, a second shaft for driving said transport means, a third shaft driven in either of two directions by said bidirectional motor depending on the direction in which said motor is operating, and coupling means including first clutch means associated with said first shaft and second clutch means associated with said second shaft for coupling said third shaft to said first shaft and to said second shaft, whereby said first shaft but not said second shaft is driven when said third shaft is driven in said other direction, and said second shaft but not said first shaft is driven when said third shaft is driven in said one direction.

5. The apparatus of claim 4, in which said operating means includes a pair of crank arms connected to said first shaft, and a pair of link members each pivotally connected at one end to said crank arms.

6. The apparatus of claim 5, in which said actuating means comprises a rod connected to the other ends of said link members.

7. The apparatus of claim 4, also including timing means for generating a series of timing signals in synchronism with the rotation of said first shaft, and electronic control means responsive to said timing signals for controlling the operation of said motor so that following the commencement of an operation of said motor in said other direction, said motor is deactivated when said first shaft has completed one revolution.

8. The apparatus of claim 7, in which said timing means comprises a timing disc secured to and rotatable with said third shaft.

9. The apparatus of claim 8, in which said timing disc carries a series of equally spaced radially extending marks, and in which said timing means also comprises a sensor for sensing said marks on said timing disc.

10. The apparatus of claim 7, also including sensing means, in which said control means is arranged to stop operation of said motor in said one direction of operation and to cause commencement of operation of said motor in said other direction of operation in response to the sensing by the sensing means that an article has been deposited in said container by said transport means.

11. The apparatus of claim 1, also including a supporting framework for said container, first support means for said container, second support means for said container, and latch means for said container, said container being pivotable into its correct operational position in said apparatus while said first support means are supported by portions of said supporting framework, said second support means being arranged to be engaged by said latch means for the purpose of latching said container into operational position.

12. The apparatus of claim 11, in which said portions of said supporting framework are support rails, and in which, in the course of said container being removed from or inserted in said apparatus, said container is slidable beneath said transport means with said first and second support means in sliding engagement with said rails.

13. The apparatus of claim 1, in which said container comprises a storage bin and means for resiliently attaching said pusher means to said storage bin, whereby said pusher means is held in resilient engagement with said actuating means throughout a reciprocable movement of said actuating means.

14. The apparatus of claim 1, in which said resilient support means comprises a block of elastomeric material which is held in somewhat compressed condition in said container, and in which movement of said pusher means from said home position to said operated position serves to bring about an additional compression of said block.

15. The apparatus of claim 14, in which said block of elastomeric material is provided with a plurality of cavities to enhance the compressibility of said block.

16. The apparatus of claim 1, also including sensing means to sense when said container has been filled to capacity with articles and to cause said control means to prevent further operation of said apparatus until said container has been removed from said apparatus for emptying.

* * * * *